US007218747B2

(12) United States Patent
Huffman

(10) Patent No.: US 7,218,747 B2
(45) Date of Patent: May 15, 2007

(54) EXTERNALLY PORTED LOUDSPEAKER ENCLOSURE

(75) Inventor: Nick Huffman, 28 Washburn St., Simi Valley, CA (US) 93065

(73) Assignee: Nick Huffman, Simi Valley, CA (US)

( * ) Notice: Subject to any disclaimer, the term of this patent is extended or adjusted under 35 U.S.C. 154(b) by 158 days.

(21) Appl. No.: 10/729,017

(22) Filed: Dec. 5, 2003

(65) Prior Publication Data

US 2005/0123162 A1 Jun. 9, 2005

(51) Int. Cl.
*H04R 25/00* (2006.01)

(52) U.S. Cl. ..... 381/345; 381/338; 381/349

(58) Field of Classification Search ..... 381/423, 381/345, 161, 162, 337–339, 397, 332, 335, 381/386, 336, 352, 341, 304, 305, 87, 349–351, 381/353, 354; 181/182, 184, 189, 198, 156, 181/185, 186, 187, 196, 199, 148, 149, 153, 181/155, 160, 144–145
See application file for complete search history.

(56) References Cited

U.S. PATENT DOCUMENTS 3,952,159 A 4/1976 Schott
3,978,941 A 9/1976 Siebert
4,169,516 A 10/1979 Honda
5,009,281 A 4/1991 Yokoyama
5,012,890 A 5/1991 Nagi et al.
5,173,575 A * 12/1992 Furukawa ..... 381/96
5,710,395 A * 1/1998 Wilke ..... 181/156
6,320,972 B1 * 11/2001 Goller ..... 381/430
6,771,787 B1 * 8/2004 Hoefler et al. ..... 381/338
7,011,178 B2 * 3/2006 Morkerken ..... 181/151

* cited by examiner

*Primary Examiner*—Huyen Le
(74) *Attorney, Agent, or Firm*—Knobbe Martens Olson & Bear LLP

(57) ABSTRACT

An externally ported speaker enclosure includes a primary enclosure having a port or opening. The primary enclosure may continuously vary from a first dimension to a dimension of the port or opening. Alternatively, a duct or tube may extend from, and external to, the primary enclosure. The duct or tube may transition from a first dimension to a dimension of the port or opening. The dimensions of the port, primary enclosure, and transition from primary enclosure to port are configured to reinforce the low frequency response of a speaker mounted to the enclosure. A cylindrical primary enclosure may transition gradually or continuously to a port. The cylindrical primary enclosure can include a closed first end and an open port end. A speaker can be mounted to the cylindrical face of the primary enclosure. Alternatively, the speaker may be mounted parallel to an axis of the cylinder.

19 Claims, 8 Drawing Sheets

EXTERNALLY PORTED LOUDSPEAKER ENCLOSURE

BACKGROUND OF THE INVENTION

1. Field of the Invention

The invention relates to loudspeaker (hereinafter "speaker") enclosures. More particularly, the invention relates to a ported speaker enclosure and a method of extending low frequency response of a speaker.

2. Description of the Related Art

A speaker enclosure greatly enhances the acoustic fidelity of sound produced by a speaker above that produced by a bare speaker driver without a speaker enclosure.

In the nineteenth century, Hermann von Helmholtz, a German physician and acoustic engineering pioneer, discovered a type of acoustic resonator known as the Helmholtz resonator. The Helmholtz resonator is a type of acoustic resonator consisting of a closed volume of air connected to the atmosphere by a short channel or pipe. The natural springiness of the enclosed air reacts with the mass of air in the pipe, which results in a tuned resonating tone that is called the fundamental tone for the pipe.

In the 1930's Jensen Company began to market a product called the "bass reflex speaker". The bass reflex speaker is a speaker enclosure that contains an opening below the speaker driver. The design of the bass reflex opening is more commonly called today as a "vent" opening port.

Two of the audio field's most respected scientists, A. N. Thiele and Richard Small, devoted much research to the analysis of the bass reflex speaker. Thiele and Small discovered that a vented enclosure acts as a resonant box even without the speaker driver mounted into the box. Thiele and Small concluded that the addition of an opening into a box created a resonator similar in theory to the Helmholtz resonator. The research of Thiele and Small also led to the creation of audio industry standards for testing acoustic drivers and speaker enclosures. Specifications commonly referred to as the Thiele or Small parameters are often used to characterize a speaker driver and a speaker system.

By the 1950's, the bass reflex speaker had been modified and a popular method implemented into speaker enclosure designs was the implementation of a duct or port, which is typically an internal tube mounted onto the opening below a speaker driver. The purpose of the duct or tube was to eliminate the resonating frequencies being produced inside the speaker enclosure and channel this information outward towards the listener. Acoustic engineers found that the implementation of the internal duct or tube created a more "boomy" response beyond that of the vent method used by the bass reflex speaker.

The numerous variations of musical styles rely on a fairly consistent choice of instruments. The instruments can include, for example, stringed, wind, and percussion instruments. Percussion instruments, such as the kick drum, create low frequency information. Cymbals and the hi-hat create high frequency information. Such percussion instruments have become standard instrumentation heard and used in contemporary music.

Improvements to the audio fidelity produced by speaker drivers and through speaker enclosures have been sought. It may be advantageous for an audio speaker product to be designed to deliver a full range of audio response. Such a full range speaker system should produce an audible response that includes low, mid and high frequency information.

Additionally, speaker enclosure systems are not limited to theater and audio reproduction environments. Over the course of 50 years, society has seen rapid growths in computers and electronics. Theater, audio, and computer markets share a common objective of creating innovative solutions to improve the quality of reproduced sound and thus keep consumers buying products. Successful companies continually strive to produce high tech innovative designs at a competitive price. For audio engineers, this typically means designing an improved audio solution at a lower cost.

The need to produce cost effective solutions leads to reduced numbers of electronic components. Cost constraints further compound the difficulties audio engineers face when designing an acceptable high fidelity and full range audio solution.

These challenges have acoustic audio engineers reviewing acoustic history in search of methods to create variations of founded theories and to implement these variations into successful audio designs.

SUMMARY OF THE INVENTION

An externally ported speaker enclosure and a method for extending the low frequency response of a speaker driver are disclosed. The externally ported speaker enclosure includes a primary enclosure having a port or opening. The primary enclosure may continuously vary from a first dimension to a dimension of the port or opening. Alternatively, a duct or tube may extend from, and external to, the primary enclosure. The duct or tube may transition from a first dimension to a dimension of the port or opening. The dimensions of the port, primary enclosure, and transition from primary enclosure to port are configured to reinforce the low frequency response of a speaker mounted to the enclosure. A cylindrical primary enclosure may transition gradually or continuously to a port. The cylindrical primary enclosure can include a closed first end and an open port end. A speaker can be mounted to the cylindrical face of the primary enclosure. Alternatively, the speaker may be mounted parallel to an axis of the cylinder.

BRIEF DESCRIPTION OF THE DRAWINGS

The features, objectives, and advantages of the invention will become apparent from the detailed description set forth below when taken in conjunction with the drawings, wherein like parts are identified with like reference numerals throughout.

DETAILED DESCRIPTION OF EMBODIMENTS OF THE INVENTION

Figure 1A:
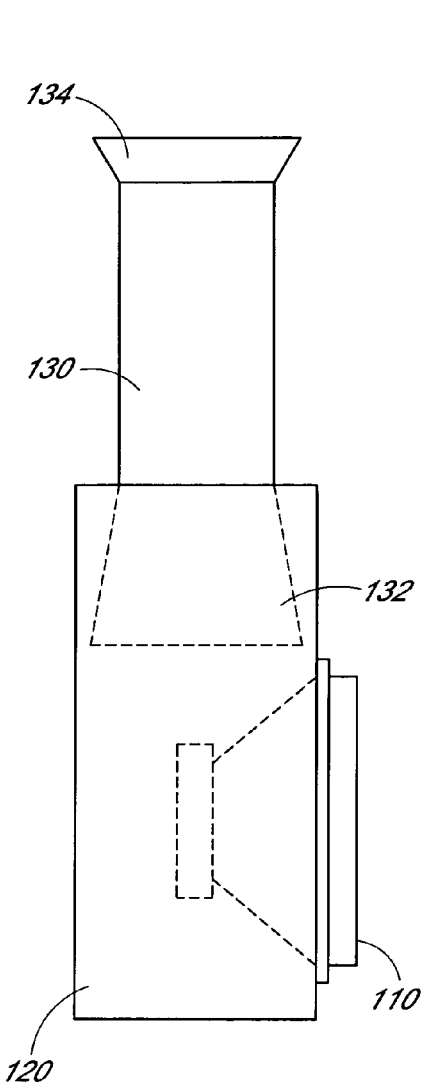
FIG. 1A–1C are diagrams of an embodiment of an externally ported speaker enclosure.

A ported or ducted configuration for a speaker enclosure is disclosed that extends the low frequency response of a speaker driver. The ported speaker enclosure includes one or more ducts or ports that couple the air internal the speaker enclosure to the air outside of the enclosure. The port or duct can be completely external to the speaker enclosure such that no duct or tube portion extends inside the enclosure. For example, the port opening can be positioned on the end of a transition section that transitions from a dimension of a primary enclosure to the dimension of the port opening. The speaker enclosure can be substantially cylindrical in form such that the transition section tapers from a primary enclosure dimension to the port dimension. The speaker enclosure can be designed to enhance selected frequencies. Typically, the design of the speaker enclosure can extend the low frequency response of a single driver housed in the enclosure, such that a single driver can be used to provide full range frequency response.

The output audio information produced by implementing the speaker driver into the speaker enclosure can have increased loudness as well as extended lower frequency information. The increased audio content is due to the speaker enclosure walls that remove phasing complications that cancel frequencies and especially lower frequencies.

The speaker enclosure design can be implemented in conjunction with various products where a full range frequency response is desirable. Such products may include notebook computers, televisions, and other applications where areas of a speaker enclosure are minimized. In some of these applications, the speaker enclosure can be expanded into other areas not utilized by conventional speaker enclosures. Implementation of the external duct or tube air port enclosure allows an extension to the speaker enclosure and can create a resonator in other areas where space allows.

The speaker enclosure can also be implemented in such products as portable stereo systems, clock radios, multimedia PC desktop speakers, surround sound and home theatre speakers, and the like. Implementation of an external duct or tube air port which is visible by the listener may be considered a contemporary design while simultaneously creating an enhanced audio solution.

The external duct speaker enclosure can also be used in conjunction with products that use external speakers. The external duct enclosure can be used as, for example, a notebook audio speaker enclosure, multimedia speaker enclosure, home speaker enclosure, outdoor speaker enclosure as well as professional speaker enclosure.

In creating the reproduced sound, a speaker driver moves alternately forward or backward in two directions much like a piston in an engine. Alternating electric current, which consists of audio information, is received by the speaker driver in alternating swings of positive and negative information. A positive signal causes the speaker driver to push air movement outwards. A negative signal causes the speaker driver to push air movement inward. The outward and inward movement of speaker the driver disrupts the surrounding air and creates waveforms in the air that are audible.

A speaker driver contains a natural resonant frequency (Fo) which will vibrate the speaker driver when the driver is slightly perturbed. The resonant frequency is typically one of the lowest frequencies that the speaker driver is able to produce.

When a speaker driver produces an audible tone such as a sine wave, a central tone is produced known as a fundamental tone. Additionally, the driver may produce harmonics based upon the fundamental tone. These harmonics can consist of multiplications of the original fundamental tone. A fundamental tone of 100 Hz can produce multiples of tones or harmonics, which can include harmonic tones of 200 Hz, 400 Hz, 800 Hz, 1200 Hz, 2400 Hz, 4800 Hz, 9600 Hz, 19200 Hz. These tones are generally considered to be within audible frequencies of the human ear. Additionally, sub-harmonics or divisions of the fundamental tone may be created.

Fletcher and Munson discovered that human hearing reacts differently to various frequencies. Fletcher and Munson measured the sensitivity of the human hearing and discovered that the sensitivity differed over the range of human hearing. This discovery lead to the creation of the Fletcher and Munson curve. Results had shown that the human ear has difficulty hearing lower frequency content as well as high frequency content. Mid range frequencies at approximately 3 KHz to 4 HKz are the primary area that is best heard by the human ear. In order for the human ear to hear the same sensitivity or loudness at frequencies such as lower frequencies or very high frequencies, an increase of sensitivity or loudness is needed to compensate for the human hearing response.

Low frequency information is difficult to recreate using a speaker because the speaker cone needs to travel further to create a longer waveform whereas mid and high frequencies need less speaker cone travel.

The performance of a speaker driver can be measured by testing the frequency response of the speaker driver. A standard measurement that reflects the frequency response produced by the driver is known as the Q. Q is the measurement of the reactive energy to the resistive energy and is calculated as the following:

$$Q=2\pi foMT/RT$$

where, fo=the system resonance frequency measured in hertz.

MT=the total system mass or speaker enclosure volume measured in kilograms.

RT=the total system damping resistance of the speaker enclosure measured in Newton seconds per meter.

The design of the speaker driver including the Q, will determine the low frequency content that is able to be produced. Although a bare speaker driver may be able to produce low frequency information, the audible low frequency output will typically not be loud.

Various factors are considered in determining the size of a speaker enclosure, including the speaker driver's specifications as well as the available area or volume allowed. The factors include, but are not limited to, the speaker driver's overall performance characteristics as well as the available speaker enclosure volume. Such speaker characteristics can include the $Q_T$ (total speaker Q), $F_s$ (speaker free air resonance of the cone), and VAS (equivalent volume compliance of the suspension on the speaker).

The implementation of the speaker driver into the speaker enclosure results in eliminating acoustic information from the rear of the speaker driver. The subtraction or elimination of audio content is known as an acoustic filter. The speaker enclosure is considered an acoustic filter because it does not allow certain acoustic information to escape. A speaker enclosure which is air tight and does not have any method to channel acoustic information from inside the speaker enclosure outwards is known as an infinite baffle design.

When a speaker driver is placed into a closed speaker enclosure also known as an infinite baffle enclosure, the speaker enclosure eliminates the rear audio content produced by the speaker driver. A closed speaker enclosure can be configured to produce a flat frequency response. A frequency response that is a flat or linear response is known as a Butterworth response.

The filtering of the acoustic information can create a linear response that is considered favorable in most frequencies. The exception being the response within the lower frequency area, which has been filtered and is also linear in response. The linear or flat response at the lower frequencies has complications due to the fact that human hearing needs increased sensitivity or loudness at lower frequency information, as is shown by the Fletcher Munson curves. As noted earlier, lower frequency content needs to be increased in volume or loudness for the human ear to simulate that the lower frequency information is level or even with other frequency content.

Active and passive equalization using a series of capacitors, resistors and other electronics can be used to alter the frequency response of a speaker driver. However, the addition of these components creates difficulty when the speaker driver is in confined areas and may consume internal speaker volume area.

Another popular acoustic speaker enclosure design is based upon the Chebychev curve, which can show an increase to the low frequency information. The increase in low frequency information improves the sensitivity or loudness of the low frequency content, and creates a response that is favorable to the findings of Fletcher and Munson.

With reference to the acoustic filter design known as the Chebychev filter, numerous speaker enclosure designs have been created including the bass reflex speaker which implements an internal duct or air tube port for increasing low frequency content output.

The internal cavity of the speaker enclosure can resonate acoustic information produced by the rear of the speaker enclosure. The audio content being created by the rear of the speaker driver is then reflected to surrounding internal walls within the speaker enclosure. A portion of the reflected audio content which contains various frequencies that have reflected from the internal walls of the speaker enclosure has been changed by the reflections so that the phase of the reflected audio content is now in parallel with the speaker driver.

Over the years numerous designs of ducts and tubes have been created using theories based upon the Helmholtz resonator. These designs include the bass reflex vent design as well as internal duct or port designs. The overall theory being that if a tuned duct or port were placed inside the speaker enclosure, the duct or port would allow acoustic information inside the speaker enclosure to escape the speaker enclosure.

The bass reflex design implements a vent built into the front below the speaker driver. The bass reflex vent had an increase in loudness as well as an increase in low frequency content. The complication with the bass reflex vent was that the opening in the vent was not particular as to which frequencies that would escape from the opening. An incorrect design of a bass reflex solution would create phase complications as well as create a nonlinear response at various frequencies.

The design of the ducted or ported speaker enclosure allows a selected tone to be produced by inserting a duct or tube into the speaker enclosure. A speaker enclosure which utilizes an internal duct or tube air port may be tuned to a specific bandwidth of frequencies. Typically, the duct or air port will be tuned to a frequency that is at or below 200 Hz depending upon the resonant frequency that the speaker driver is able to produce. The duct or air port opening can be tuned to a specific frequency but will also accept a frequency bandwidth which is near the tuned frequency that is selected (e.g. fundamental tone=100 Hz, a bandwidth of 95 Hz to 105 Hz may also be audible).

The implementation of the duct or port speaker enclosure design has a favorable response similar to that of the Chebychev curve. The implementation of the duct or tube port is similar in use to that of Helmholtz, who also used a pipe type of resonator.

An increase in low frequency content occurs with the usage of a duct or tube port. Since the duct or tube port resonator is tuned to a specific frequency, only the tuned frequency and a bandwidth of frequencies near that tuned frequency as well as harmonics built upon the tuned frequency are output from the duct or tube port.

The theory of an external duct or tube air port speaker enclosure is similar in theory to that of an internal duct or tube port design. The external duct or tube enhances low frequency content as well as mid and high frequency content, which is selectively tuned to the duct or tube external port. Since the duct or tube air port is external from the speaker enclosure, there is also an increase in internal volume of the speaker enclosure.

Figure 1B:
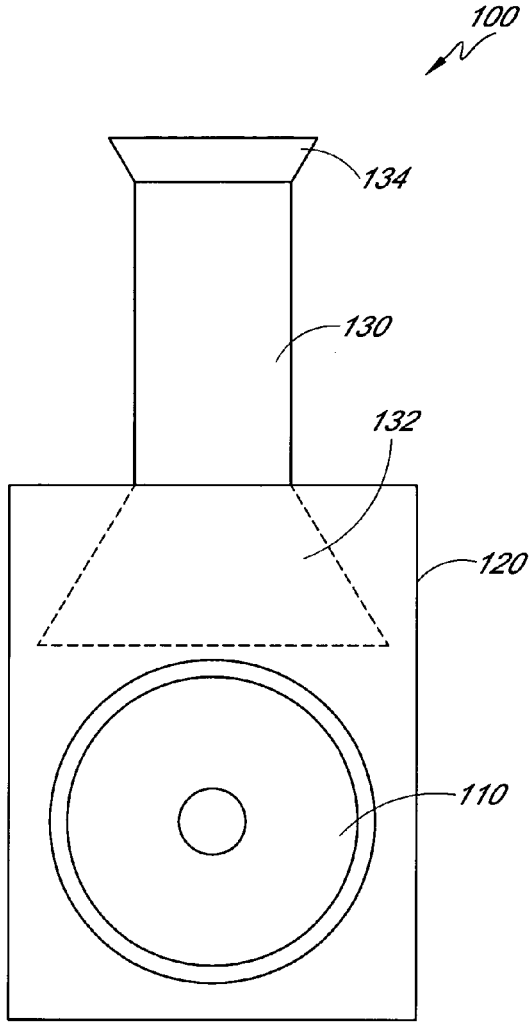
Figure 1C:
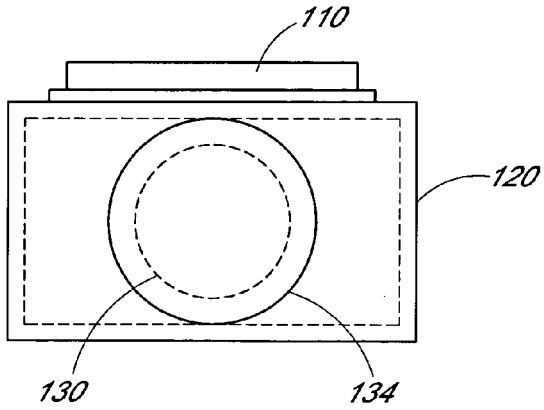

FIG. 1 is a diagram of an embodiment of an externally ported speaker enclosure 100. The enclosure 100 includes a speaker 110 mounted on a face of a primary enclosure 120. A front of the speaker 110 faces outward from the primary enclosure 120. The front of the speaker 110 produces acoustic information having a given phase when the speaker is driven with an electrical signal. The rear of the speaker 110 faces the internal volume of the primary enclosure 120. The rear of the speaker 110 produces acoustic information having a phase that is opposite the phase of the acoustic information produced by the face of the speaker 110.

A port or duct 130 extends from the primary enclosure 100. The port 130 is configured to allow airflow through the port 130. The primary enclosure 120 is typically sealed except for the portion coupled to the port 130.

The port 130 is coupled to the internal volume of the primary enclosure 120 and extends outward from the primary enclosure 120. Thus, air can pass from the internal volume of the primary enclosure 120, through the port 130, and outward external to the primary enclosure 120. The dimensions of the port 130 are designed such that select frequency components exiting the port 130 are in phase with the corresponding frequency components produced by the front of the speaker.

The port 130 terminates at an end that is opposite the primary enclosure 100. The end of the port 130 can include a termination 134 that can be shaped. The termination 134 can be, for example, flared, rolled, conical, radiused, elliptical, and the like or some other shape. In some embodiments, the termination 134 is omitted.

The internal volume of the port 130 and termination 134 contribute to the internal volume of the primary enclosure 120. Thus, the enclosure 100 includes an internal volume that is the sum of the internal volumes of the primary enclosure 120, port 130, and termination 134.

The port 130 and termination 134 are open, such that airflow through the port 130 is substantially unimpeded. That is, an occlusion such as a grill or grill cloth may be disposed over the opening of the port 130 provided the airflow through the port 130 is substantially unimpeded. Airflow is substantially unimpeded if the occluded port 130 flows at least one half the unimpeded airflow.

The port 130 can also include a transition section 132 that extends into the internal volume of the primary enclosure 120. As was the case with the termination 134, the transition section 132 can be shaped. The transition section 132 can have the same shape as the termination 134, as shown in FIG. 1. In other embodiments, the transition section 132 can be of a different shape or dimension relative to the termination 134. In still other embodiments, the transition section 132 is omitted.

The transition section 132 can be configured such that an end extending furthest into, or nearest, the primary enclosure 120 has an opening that is substantially equal to the internal dimension of the primary enclosure 120. Alternatively, the opening of the end of the transition section 132 can be smaller than the internal dimension of the primary enclosure 120. The largest opening of the transition section 132 is preferably sized to allow the desired frequency components to couple to the port 132. For example, the transition section 132 can be radiused from a dimension that is substantially equal to the internal dimension of the primary enclosure 120 to the dimension of the port 130.

The speaker 110 in FIG. 1 and the speakers described throughout the document may alternatively be referred to as loudspeakers, speaker drivers, drivers, audio sources, acoustic drivers, acoustic apparatus, acoustic sources, and the like, or means for generating audio. The port described throughout the description can alternatively be referred to as a duct, channel, audio path, acoustic path, guide, and the like. The ports can be configured to be tubes having uniform cross section or they may vary in cross section. Additionally, the port cross sections may at some point be circular, oblong, ellipsoid, oval, tear dropped, square, rectangular, polygonal, or some other configuration.

In the enclosure of FIG. 1, as well as the other external port speaker enclosures, the internal duct opening inside the speaker enclosure can be designed to receive audio information from the speaker driver and reflections from the internal walls of the speaker enclosure.

The internal opening of the duct or port can be positioned near the rear of a speaker driver or in a way to be able to receive as much reflection from the speaker enclosure internal walls as possible. The internal opening of the duct or port can be positioned on any of the side or rear walls.

The audio information produced by the speaker driver's inward movement enters into the duct or tube opening along with reflections from the surrounding walls of the speaker enclosure. Certain frequencies will be filtered out from entering the duct or port due to the duct or tube opening and length. Frequencies which successfully enter the duct or port opening will travel through the mid-section, transition region, of the duct or tube and attempt to proceed outward.

The duct or port section can be designed to resonate at a selected frequency. The selected resonating frequency of the duct or air port and a frequency bandwidth near the resonant frequency, as well as the harmonic frequencies of the resonating frequency will travel through the duct or port. Oscillations of the tuned frequency will resonate along the internal walls of the duct or tube air port.

The duct or tube mid section, or transition region, will channel the audio information received from the internal opening of the speaker enclosure. The dimensions of the duct or tube air port may prevent certain frequencies from reaching the external output of the duct or tube.

The opening or port is located outside of the speaker enclosure. The mid section or transition of the external duct or tube air port comes to an end at an external opening or port.

Audio information which successfully passed through the mid section, or transition, of the external duct or tube is passed through the external opening. The audio information output can contain low frequency information as well as mid and high frequency content that is derived from the harmonic structure of the fundamental tone of the duct or tube air port as well as the bandwidth of frequencies near the fundamental tone as well as the associated harmonics.

The audio output from the duct or tube air port can be enhanced in a direction which is towards the listener. However, if the selected frequency enhanced by the duct is based upon a low frequency, directionality is not considered important because low frequency information is largely non-directional. Audible resonating frequencies produced by the external tube air port will increase overall loudness as well as accentuate desired frequencies.

Figures 2A, 2B, 2C:
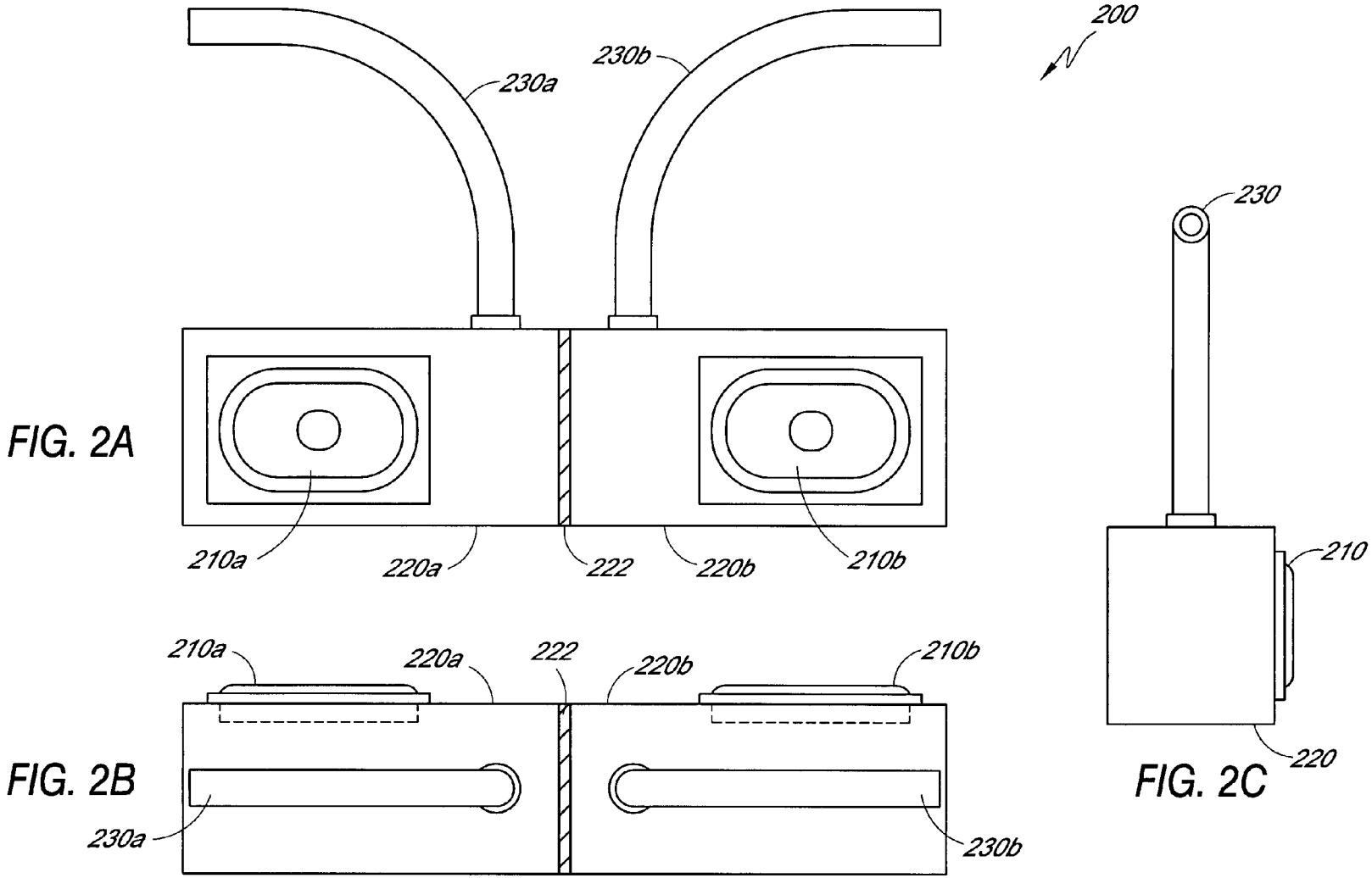
FIGS. 2A–2C are diagrams of another embodiment of an externally ported speaker enclosure.

FIG. 2 is another embodiment of an externally ported speaker enclosure 200. The externally ported speaker enclosure 200 is configured for two separate drivers, 210*a* and 210*b*. Such a configuration can be used, for example, to provide stereo sound.

The speaker enclosure 200 includes a first primary enclosure 220*a* housing a first speaker driver 210*a* and a second primary enclosure 220*b* housing a second speaker driver 210*b*. The first and second primary enclosures, 220*a* and 220*b*, can be, for example, manufactured from a single enclosure having a dividing wall 222 separating the primary enclosures. A first duct or port 230*a* extends from the first primary enclosure 220*a*. Similarly, a second duct or port 230*b* extends from the second primary enclosure 220*b*. The first and second ports, 230*a* and 230*b*, are tubular and hollow. The first and second ports 230*a* and 230*b* are substantially open at the ends and couple the air on the outside of the enclosure 200 to the interior of the associated primary enclosures, 220*a* and 220*b*. It may be advantageous for the primary enclosures 220*a* and 220*b* to be air tight except for the portion exposed by the ducts 230*a* and 230*b*. Thus, the only air path from the inside of the primary enclosures 220*a* and 220*b* to the outside of the enclosure 200 passes through the respective first and second ports 230*a* and 230*b*.

The dimensions of the first port 230*a* are chosen to allow certain frequencies generated by the front of the first speaker driver 210*a* to be reinforced by audio information generated by the first speaker driver 210*a* internal to the first primary enclosure 220*a*. The phase of the audio information generated by the rear of the first speaker driver 210*a* is out of phase relative to the audio information generated at the front of the first speaker driver 210*a*. The dimensions of the first port 230*a* are selected such that the audio information exiting from the port 230*a* is in phase with the audio information generated at the front of the first speaker driver 210*a* over a predetermined frequency band. It may be advantageous for the dimensions of the first duct 230*a* to be selected such that bass frequencies are reinforced.

The dimensions of the second port 230*b* are also selected to reinforce a frequency band of the second speaker driver 210*b*. The first and second ports 230*a* and 230*b* can have similar or distinct dimensions. Thus, the frequency response of the first speaker driver 210 may differ from the frequency response of the second speaker driver 210*b* when configured within the speaker enclosure 200.

The ports 230*a* and 230*b* are shown as curved to minimize the height required to accommodate the port length. Substantially all of the port length is external to the associated primary enclosures 220*a* and 220*b*. The volume of air within the ports contributes to the volume of air within the speaker enclosure 200.

Figure 3A:
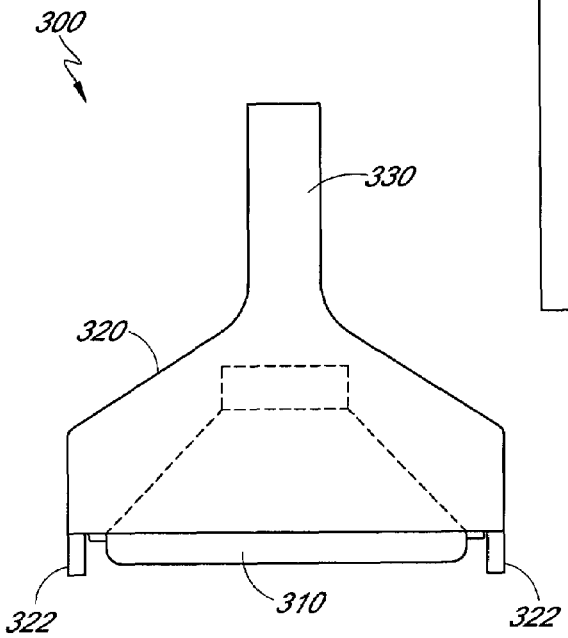
FIG. 3A–3C are diagrams of another embodiment of an externally ported speaker enclosure.
Figure 3B:
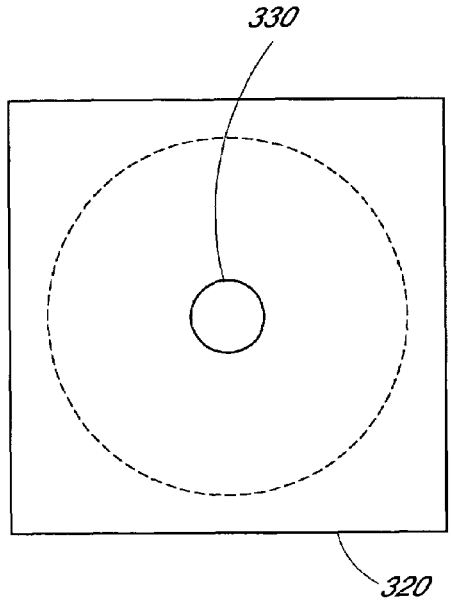
Figure 3C:
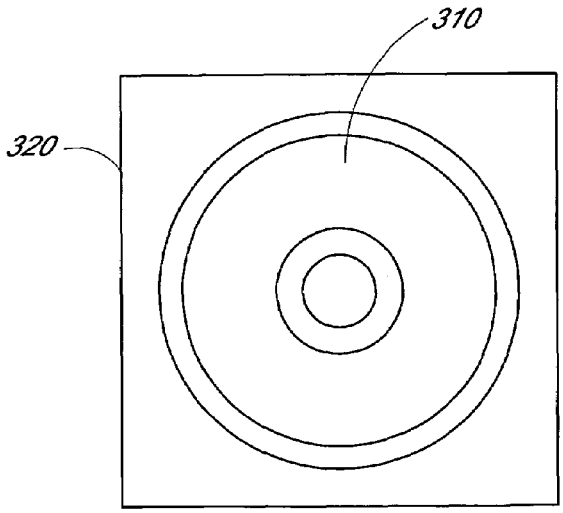

FIG. 3 is another embodiment of an externally ported speaker enclosure 300. The speaker enclosure 300 can include a primary enclosure 320 that houses a speaker driver 310. The primary enclosure 320 can transition to a port section 330. The speaker enclosure 300 can be configured to be mounted with the speaker driver facing out to one side. Alternatively, the speaker enclosure 300 can be configured such that the speaker driver 310 faces downward. When a down firing speaker configuration is used, the speaker enclosure 300 may include feet or supports 322*a*–322*b* to elevate the speaker driver 310 above a surface.

As before, the port section 330 includes an open end that couples the outside air to the air within the speaker enclosure 300. The primary enclosure 320 continuously and gently transitions to the port section 330. The primary enclosure 320 includes an interior portion that reduces from the dimension of the primary enclosure 320 to the dimension of the port section 330. It may be advantageous for the reducing section to provide a continuous transition that is free of sharp angles or sudden dimension changes. It may also be advantageous for all of the angles within the transition to be radiused or curved, rather than angular.

The port section 330 is centered behind the speaker driver 310. In other embodiments, the port section 330 is not centered behind the speaker driver, but instead is offset from the center of the driver. In other embodiments, the axis of the port section 330 is different from the axis of the speaker driver 310.

Figure 4:
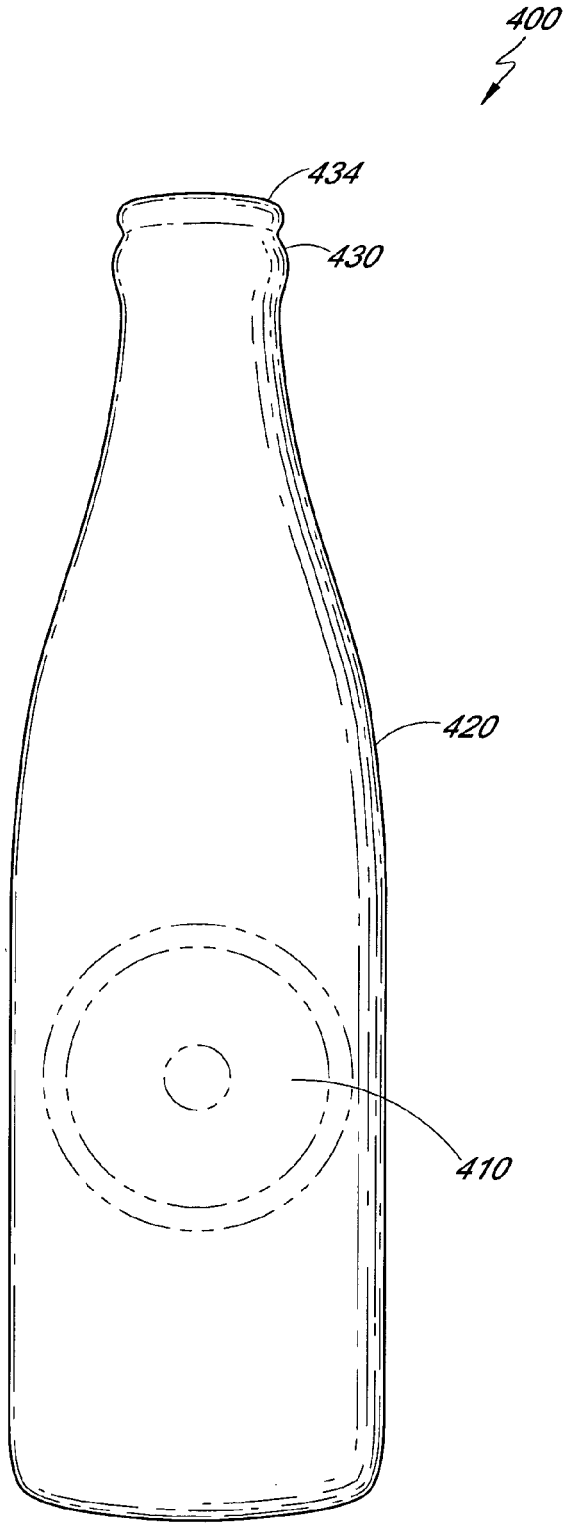
FIG. 4 is a side elevation view of another embodiment of an externally ported speaker enclosure.

FIG. 4 is still another embodiment of an externally ported speaker enclosure 400. The configuration of the externally ported speaker enclosure having a primary enclosure, transition region, and port section, is adaptable for use in conjunction with a variety of ornamental designs that are aesthetically pleasing. For example, the externally ported speaker enclosure 400 can be manufactured to resemble a bottle. In other embodiments, the enclosure can be shaped like an article of commerce, such as a guitar, suit case, rocket, figurine, and the like, provided the design include the functional elements described herein.

As in previous embodiments, the speaker enclosure 400 includes a primary enclosure 420 that transitions to a port section 430. The port section 430 includes a termination 434 at the open end opposite the primary enclosure 420. The termination 434 can include a flare, curve, or radius formed on the end of the port section 430. A speaker driver 410 is mounted in the primary enclosure 410.

The primary enclosure 420 is substantially cylindrical in shape. That is, the cross section of the primary enclosure 420 is substantially circular. The primary enclosure 420 need not be perfectly cylindrical, but may have portions having reduced or expanded diameters relative to an average diameter. The primary enclosure 420 is sealed on one end of the cylinder. The opposite end of the cylinder remains open and continuously transitions to the port section 430. Thus, the speaker enclosure 400 represents an open bottle shape. The body of the bottle can be the primary enclosure 420, the transition region of the bottle represents the transition region from the primary enclosure 420 to the port section 430. The neck of the bottle forms the port section 430. One can envision various ornamental bottle shaped speaker enclosure embodiments having modifications to the shape or outer surface of the bottle to represent various different bottle types, and configurations.

The speaker driver 410 is mounted on the cylindrical face of the primary enclosure 420. In one embodiment, the speaker driver 410 is mounted within the cylindrical portion of the primary enclosure 420 away from the region that transitions to the port section 430. The axis of the port section 430 is substantially coincident with the axis of the cylindrical primary enclosure 420. The axis of the speaker driver 410 is substantially perpendicular to the axis of the port opening. The speaker driver 410 can be mounted on the face of the cylindrical primary enclosure 420 at a height that is approximately 25% of the total height of the speaker enclosure 400. The height of the speaker enclosure 400 is measured from the bottom surface internal to the primary enclosure 410 to the port opening. Alternatively, the axis of the speaker driver 410 may be mounted at a height that is less than 10%, 15%, 20%, 25%, 30%, 35%, 40%, 50%, 60%, 70%, 75%, or 80% of the height of the speaker enclosure 400.

The transition from the primary enclosure 420 to the port section is continuous, without sharp angles or stepped sections. In a particular embodiment, the transition is continuous and lacking any acute angles. In another embodiment, the transition occurs in a section that is substantially equal in length to the length of the primary enclosure 420. In other embodiments, the transition occurs in a length that is less than 60%, 50%, 40%, 30%, 25%, 20%, or 10% of the total height of the speaker enclosure 400.

In one embodiment, the cross section of the port opening is smaller than one half the cross section of the primary enclosure 410. In other embodiments, the cross sectional area of the port opening is less than 10%, 15%, 20%, 25%, 30%, 40% or 50% of the cross sectional area of the primary enclosure 410. Additionally, the length of the port section 430 is substantially less than the total height of the speaker enclosure 400. For example, the length of the port section may be less than 50%, 40%, 30%, 25%, 20%, 15%, 10%, or 5% of the total height of the speaker enclosure 400. However, the port may be extended if needed depending upon the desired tuned frequency.

The total enclosure volume, transition length, driver placement, and port size all contribute to the frequency response of the system including the speaker driver and speaker enclosure. The total volume of the speaker enclosure 400 includes the internal volume of the primary enclosure 420, transition region, and port section 430. The total volume can be, for example, approximately 0.5 liter, 0.75 liter, 1 liter, 1.5 liter, 2 liters, or some other enclosure volume. Alternatively, the total volume can be less than 0.5 liter, 0.75 liter, 1 liter, 1.5 liter, 2 liters, 4 liters, 5 liters, 10 liters, or some other enclosure volume. The dimensions of the speaker enclosure can be selected, for example, to enhance a low frequency response of the speaker driver 410.

In one embodiment, the total internal volume of the speaker enclosure 400 is less than 0.5 liters. The cross section of a cylindrical primary enclosure is less than 6 cm and about 3 cm. The cross section of the port is less than 10 cm and about 3 cm. The total height of the speaker enclosure is less than 20 cm. The speaker driver is a full range speaker driver having a diameter that is less than 4.5 cm. The axis of the speaker driver is mounted 6 cm from the bottom of the primary enclosure. The speaker enclosure having the stated dimensions can reinforce the low frequency response of the full range speaker, thereby improving the total frequency response.

Figure 5:
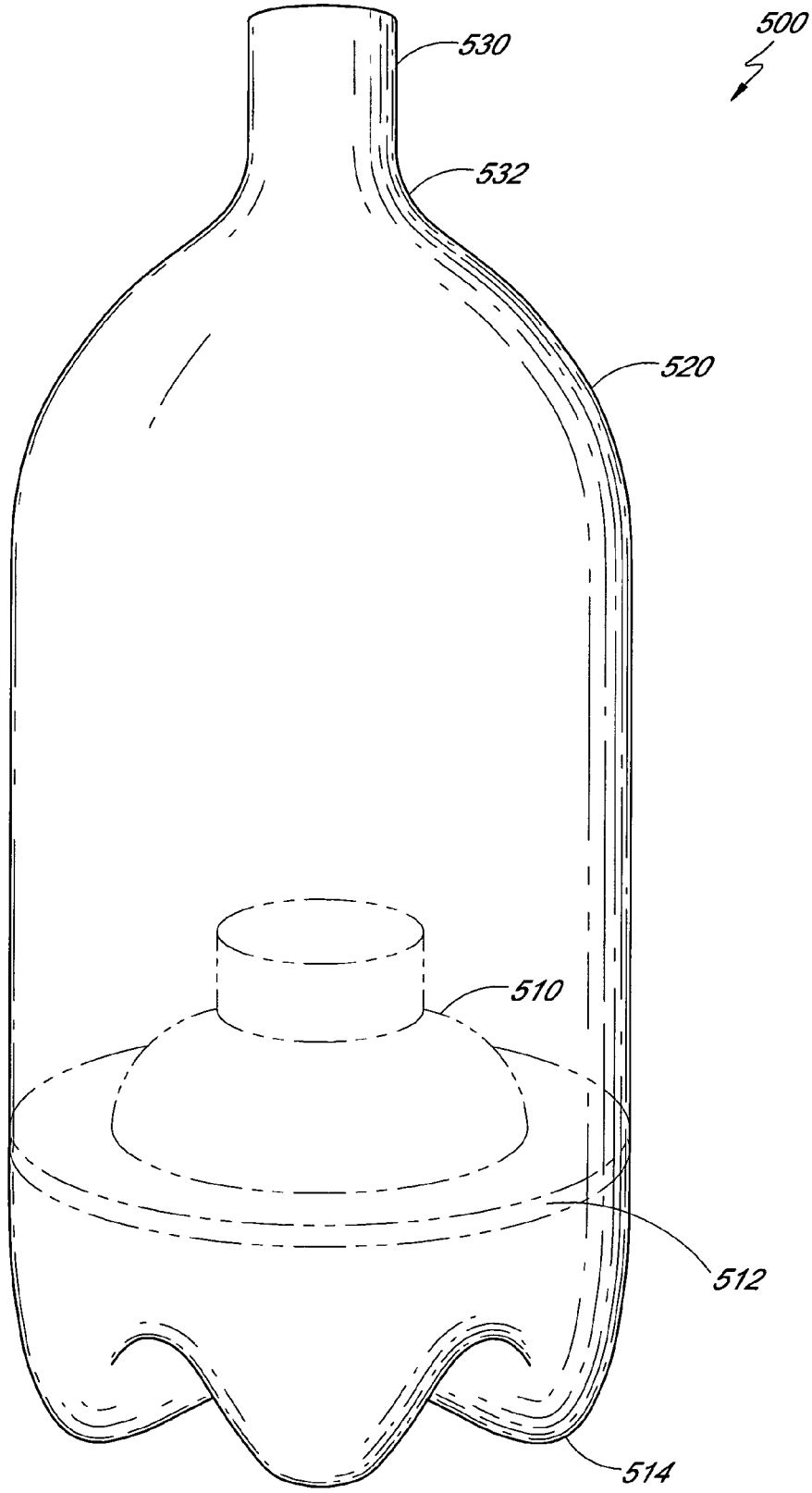
FIG. 5 is a side elevation view of another embodiment of an externally ported speaker enclosure.

FIG. 5 is another embodiment of the invention, including an externally ported speaker enclosure 500. The externally ported speaker enclosure 500 is also formed in the aesthetically pleasing shape of a bottle. The speaker enclosure 500 of FIG. 5 is similar to the speaker enclosure 400 of FIG. 4, except for the configuration of the speaker driver 510.

The speaker enclosure 500 includes a primary enclosure 520 that transitions to a port section 530. An end of the port section 530 opposite the primary enclosure 520 is open and couples air external to the primary enclosure 520 to air within the primary enclosure 520.

A speaker driver 510 is mounted on a baffle 512 mounted at one end of the primary enclosure 520. A support or mount 514 can be positioned beneath the baffle 512 to allow the speaker driver 510 to operate in a down firing configuration. The support or mount 514 is typically perforated or otherwise transparent to acoustic information generated by the front of the speaker driver 510.

A speaker driver 510 is mounted such that the axis of the driver is substantially parallel to the axis of the port section 530. The baffle 512 is sealed to the side walls of the primary enclosure 520 and can form one end of the primary enclosure 520.

The primary enclosure 520 can be cylindrical shaped as was the primary enclosure 420 of the speaker enclosure 400 of FIG. 4. The transition region 532 between the primary enclosure 520 and the port section 530 is continuous and void of sharp angles or stepped regions.

Again, as was the case with the externally ported speaker enclosure 400 of FIG. 4, the externally ported speaker enclosure 500 of FIG. 5 is bottle shaped. The body of the bottle forms the primary enclosure 520 and the transition region of the bottle is the transition region 532 of the speaker enclosure 500. Additionally, the neck of the bottle forms the port section 530. Thus, the aspects of the externally ported speaker enclosure 500 can be adapted for use in conjunction with an ornamental design resembling a bottle.

The dimensions of the speaker enclosure 500 may be configured similar to the dimensions of the speaker enclosure 400 of FIG. 4. In one embodiment, the speaker enclosure 500 includes a total internal volume that is less than 2 liters. The diameter of the cylindrical primary enclosure 520 is approximately 9 cm. The speaker driver is less than 10.2 cm (4 inches) in diameter. The port opening is less than 3.8 cm (1.5 inches) in diameter and about 5 cm in diameter. The port section 530 is less than 5.1 cm (2 inches) in length and about 3 cm in length. The overall height of the speaker enclosure is less than 40 cm in length. A speaker in an enclosure having the stated dimensions can be used, for example, as a bass or subwoofer speaker having enhanced low frequency response.

Figure 6B:
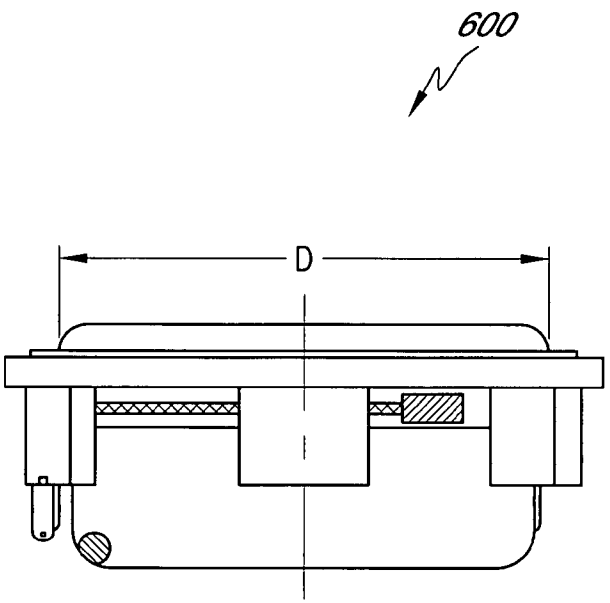
FIGS. 6A–6B are diagrams of embodiments of full range speakers that can be used within speaker enclosures.
Figure 6A:
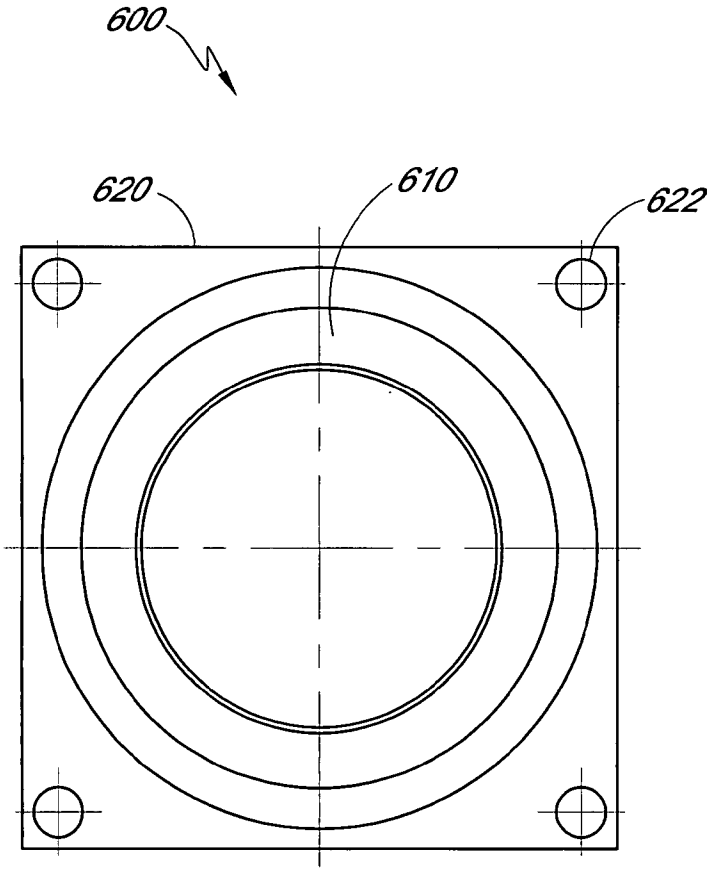

FIGS. 6A–6B are views of a full range speaker that can be used a speaker enclosure. FIGS. 6A–6B are views of a full range speaker having large diaphragm excursions that enable the speaker to have a low frequency response not normally found within speakers of the same size. The long throw diaphragm design allows the speaker to move large volumes of air required for low frequency response. The speaker can be considered a full range speaker if the frequency response covers at least the frequency range of 200 Hz–2 kHz. The frequency response can be measured, for example, based on −3 dB, −6 dB, or −10 dB points in the response curve. The speaker 600 can be incorporated in the various enclosure embodiments discussed above in order to extend the low frequency response of the speaker 600.

In particular, FIGS. 6A–6B show an embodiment of a long excursion speaker 600. Such a speaker can be, for example, a Boost Hipster Mighty Mite series driver. The speaker 600 can include a diaphragm 610 mounted to a base 620. The base 620 can include one or more through holes, for example 622, for mounting the driver 600. The speaker 600 can have, for example, a diaphragm 610 that is approximately 2 cm in diameter and less than 2.5 cm. The diaphragm 610 excursion may be approximately 1 to 1.5 cm. Such a speaker 600 can have a free air resonance of approximately 410 Hz and less than 420 Hz.

Similar speaker 600 configurations having a diaphragm 610 that is approximately 2 cm in diameter but less than 2.5 cm and an excursion of approximately 1 cm can have a free air resonance of approximately 269 Hz and less than 275 Hz. A similar speaker 600 configuration can include a diaphragm of approximately 3 cm in diameter and less than 3.5 cm. The speaker can also have an excursion of approximately 2–2.5 cm and can have a free air resonance of approximately 154 Hz and less than 160 Hz.

Figure 7A:
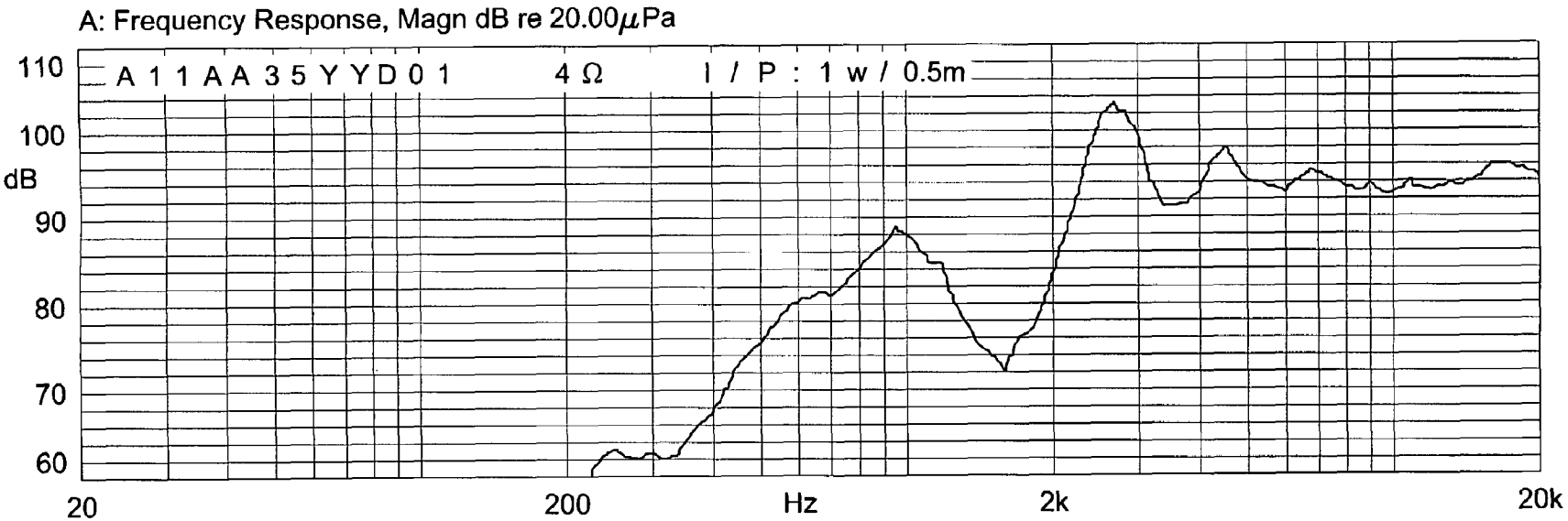
FIGS. 7A–7B are speaker frequency response plots.

FIG. 7A is a frequency response plot 700 of a long excursion speaker having a diaphragm diameter that is approximately 2.5 cm and less than 3 cm, such as the speaker driver of FIG. 6. The frequency response is measured at one watt and 0.5 meters distance on axis with the speaker. As can be seen from the frequency response plot 700 of the raw speaker driver without an enclosure, the −6 dB frequency response extends from approximately 2000 Hz to above 20 kHz. The −6 dB frequency point is measured from the average of the flat response, excluding variations that are likely attributable to underdamping of the speaker driver.

Figure 7B:
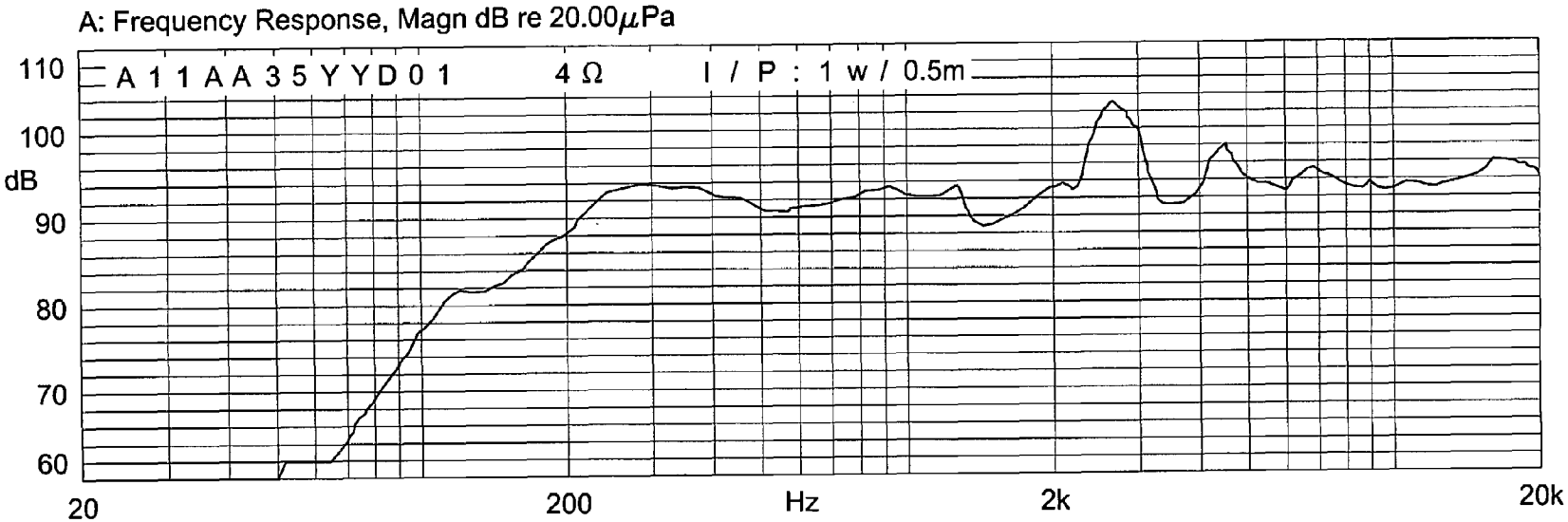

FIG. 7B is a frequency response plot 750 of a long excursion speaker driver, such as the driver of FIG. 6, in a speaker enclosure similar to the one shown in FIG. 4. The speaker driver is the same type as was used to produce the frequency plot 700 of FIG. 7A. The internal enclosure volume was approximately 0.35 liters and less than 0.4 liters. The height of the enclosure was approximately 15 cm and less than 30 cm. The port opening was approximately 1.75 cm and less than 2.5 cm. Additionally, the axis of the speaker driver was mounted approximately 6 cm and less than 7 cm above the internal floor of the enclosure.

As can be seen from the frequency response plot 750 of the speaker within an enclosure, the low end frequency response is greatly extended. The −6 dB frequency response extends from approximately 200 Hz to above 20 kHz. Once again, the frequency response is measured from the average of the flat response and does not take into account peaks and valleys in the frequency response.

The speaker response at frequencies below approximately 2 kHz and above approximately 200 Hz is greatly improved using the externally ported speaker enclosure. For example, the magnitude of the response at 300 Hz is approximately 60 dB without the enclosure and is approximately 94 dB with the externally ported speaker enclosure. Thus, the speaker enclosure contributes approximately 34 dB improvement to the 300 Hz frequency response.

Of course, the particular combination of speaker driver and enclosure produced the frequency response shown in FIG. 7B. Different enclosure designs having different volumes and different shapes can produce different frequency responses.

Thus, it can be seen that an external ported speaker enclosure can enhance selected frequencies. The speaker enclosure can be designed to enhance the low frequency response of a speaker driver. A speaker enclosure can be combined with a small diameter, long throw, driver to produce a speaker having small dimensions but a full range frequency response.

The above description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A speaker system, comprising;

a primary enclosure having at least one wall forming side surfaces of said primary enclosure and surrounding a volume of air, said primary enclosure having an open upper end and a sealed lower end;

a speaker driver mounted to a wall of the primary enclosure such that a front face of the speaker driver is external to the primary enclosure and a rear face of the speaker driver is internal to the primary enclosure;

a port section comprising a duct extending external to said primary enclosure, said duct enclosing a volume of air which is coupled to the volume of air of the primary enclosure to increase internal volume of the speaker system, a port opening coupling air from inside said duct to air external to the speaker system, wherein said port section comprises dimensions designed such that select frequency components exiting the speaker system through the port section are in phase with corresponding frequency components produced by said speaker driver to extend low frequency response of said speaker system; and a transition region coupling the primary enclosure to the port section such that air in the primary enclosure is coupled to air external to the speaker system via the port opening, wherein the transition region comprises a transition section connected to said open upper end of said primary enclosure and extending external to the primary enclosure, the transition section tapering relative to a side surface of the primary enclosure defining a continuous transition from the primary enclosure to the port section and sized to allow the select frequency components to couple to said port section.

2. The speaker system of claim 1, wherein the transition region comprises:

a first end having a first end opening coupled to air within the primary enclosure volume, the first end opening having dimensions substantially equal to an internal dimension of the primary enclosure; and a second end coupled to the first end and also coupled to the port section, the second end having a second end opening, the second end opening having dimensions substantially equal to an internal dimension of the port opening.

3. The speaker system of claim 1, wherein the primary enclosure comprises a cylindrical enclosure, and wherein said duct comprises a cylindrical duct.

4. The speaker system of claim 1, wherein said speaker driver is mounted to a wall forming a side surface of the primary enclosure such that a vertical axis through the centerline of a cross-section of the port opening is substantially perpendicular to an axis normal to the front face of the speaker driver.

5. The speaker system of claim 1, wherein the speaker driver comprises a full range speaker driver having a free air resonance less than 420 Hz and a diaphragm dimension less than 35 cm.

6. A speaker system, comprising:

a substantially cylindrical primary enclosure comprising a substantially cylindrical wall defining a primary enclosure volume, said primary enclosure having an open end and a closed end;

a speaker driver mounted to the cylindrical wall of the primary enclosure, a front face of the speaker driver positioned external to the primary enclosure and a rear face of the speaker driver positioned internal to the primary enclosure;

a substantially cylindrical port section having first and second open ends, comprising a substantially cylindrical duct extending external to said primary enclosure, said duct enclosing a volume of air which is coupled to air in the primary enclosure volume to increase internal volume of the speaker system, a port opening on one end of said port section coupling air from inside said duct to air external to the speaker system, wherein said port section is tuned to a selected frequency to extend low frequency response of said speaker driver; and a transition section having a first open end coupled to the open end of the primary enclosure and a second open end substantially opposite the first open end, the second open end coupled to the end of the port section opposite the port opening, said transition section tapering from a dimension of said primary enclosure to a dimension of said duct.

7. The speaker system of claim 6, wherein an axis normal to the face of the of the speaker driver is substantially perpendicular to a vertical axis through the center of a cross-section of the port section.

8. The speaker system of claim 6, wherein dimensions of the first open end of the transition section substantially match dimensions of the open end of the primary enclosure, said transition section tapering relative to the wall of the primary enclosure to define a continuous transition from the primary enclosure to the port section, and wherein said transition section is sized to allow selected frequency components to couple to said port section.

9. The speaker system of claim 6, wherein dimensions of the second open end of the transition section substantially match dimensions of the end of the port section opposite the port opening, and wherein said duct comprises an elongated cylindrical duct.

10. The speaker system of claim 6, wherein the primary enclosure further comprises a body portion of a bottle.

11. The speaker system of claim 6, wherein the port section comprises a neck of a bottle.

12. The speaker system of claim 6, wherein the port section and the transition section are external to the primary enclosure.

13. The speaker system of claim 6, wherein the speaker driver comprises a full range speaker driver having a free air resonance less than 420 Hz and a diaphragm dimension less than 35 cm.

14. The speaker system of claim 6, wherein the first open end of the transition section has about the same diameter as the open end of the primary enclosure.

15. The speaker system of claim 6, wherein the first open end of the transition section has about the same diameter as an internal dimension of the primary enclosure.

16. The speaker system of claim 6, wherein the transition section comprises a tapered portion of the neck of a bottle.

17. The speaker system of claim 6, wherein said port section is tuned to a frequency that is at or below 200 Hz.

18. A speaker system, comprising:

a substantially cylindrical primary enclosure having an open end and a closed end and having diameter of less than 30 cm, said primary enclosure having at least one wall forming side surfaces and surrounding a primary enclosure volume;

a full range speaker driver mounted to a side surface of the primary enclosure with an axis of the speaker driver mounted less than 7 cm above the closed end, a front face of the speaker driver positioned external to the primary enclosure and a rear face of the speaker driver positioned internal to the primary enclosure;

a substantially cylindrical port section comprising a duct extending external to said primary enclosure, said duct having open ends of less than 2.5 cm diameter, and wherein said port section is tuned to a selected frequency to extend low frequency response of said speaker system; and a transition section having a first open end coupled to the open end of the primary enclosure and a second open end substantially opposite the first open end, the second open end coupled to the port section, said transition section tapering from a dimension of said primary enclosure to a dimension of said port section.

19. The speaker system of claim 18, wherein a diameter of the speaker driver is less than 3 cm.

* * * * *